US006584669B1

(12) United States Patent
Gourdet et al.

(10) Patent No.: US 6,584,669 B1
(45) Date of Patent: Jul. 1, 2003

(54) METHOD FOR PRODUCING METAL SHAPES WITH A POLYGONAL CROSS-SECTION BY MEANS OF CONTINUOUS CASTING ON A DOUBLE-FLANGED WHEEL AND CONTINUOUS ROLLING

(75) Inventors: Christian Gourdet, Castelsarrasin (FR); Gerard Thomas, Montreuil-Juigne (FR)

(73) Assignee: Aluminium Pechiney, Paris (FR)

( * ) Notice: Subject to any disclaimer, the term of this patent is extended or adjusted under 35 U.S.C. 154(b) by 0 days.

(21) Appl. No.: 09/700,717

(22) PCT Filed: Jun. 9, 1999

(86) PCT No.: PCT/FR99/01360

§ 371 (c)(1),
(2), (4) Date: Jan. 29, 2001

(87) PCT Pub. No.: WO99/64176

PCT Pub. Date: Dec. 16, 1999

(30) Foreign Application Priority Data

Jun. 10, 1998 (FR) ..... 98 07478

(51) Int. Cl.[7] ..... B23P 17/00; B22D 11/00
(52) U.S. Cl. ..... 29/527.7; 164/476; 164/482
(58) Field of Search ..... 29/527.7; 72/234, 72/235; 164/417, 433, 434, 442, 476, 482, 484

(56) References Cited

U.S. PATENT DOCUMENTS

| | | | | |
|---|---|---|---|---|
| 3,517,537 A | | 6/1970 | Cofer | |
| 3,677,056 A | | 7/1972 | Properzi | |
| 3,729,973 A | | 5/1973 | Wykes | |
| 3,881,337 A | | 5/1975 | Cofer et al. | |
| 3,996,780 A | * | 12/1976 | German | 72/197 |
| 4,287,934 A | * | 9/1981 | Ward | 164/482 |

FOREIGN PATENT DOCUMENTS

| | | |
|---|---|---|
| DE | 213605 | 9/1984 |
| FR | 1433460 | 6/1966 |
| GB | 2047591 | 12/1980 |

OTHER PUBLICATIONS

"Standardization of Roll Pass Design for Bar Mills", Conneely, Iron and Steel Engineer, vol. 69, No. 5, May 1, 1992, pp. 38–42.
"Mastering the Rolling of Shapes on a Single Pass Mill", Skryabin et al, Iron and Steel Engineer, vol. 20, No. 11/12, 11/96, pp. 776–778.

* cited by examiner

*Primary Examiner*—P. W. Echols
(74) *Attorney, Agent, or Firm*—Dennison, Schultz & Dougherty

(57) ABSTRACT

The invention relates to a method for producing metal shapes with a partially or totally polygonal cross-section by means of continuous casting in a double-flanged wheel and continuous rolling using a series of at least 3 pairs of rollers with a peripheral flange, whereby said rollers are alternately horizontally and vertically disposed in a symmetrical position with respect to said shape. The inventive method is characterised in that the flanges of the first pairs of rollers are identical to those used to produce shapes with a circular cross-section; the last pair of rollers has flanges defining a section that corresponds substantially to that of the desired shape; the section formed by the grooves of the last pair of rollers has curve radiuses of between 1 and 5 mm at the highest points of the polygon; the sides of the polygon that are not parallel to the air gap pertaining to the last pair of rollers have a clearance angle of ½–3° in comparison with the corresponding of the section of the final shape. The invention can be used to produce copper or aluminum alloy shapes for drawing or and/or subsequent redrawing.

16 Claims, 3 Drawing Sheets

METHOD FOR PRODUCING METAL SHAPES WITH A POLYGONAL CROSS-SECTION BY MEANS OF CONTINUOUS CASTING ON A DOUBLE-FLANGED WHEEL AND CONTINUOUS ROLLING

FIELD OF THE INVENTION

The invention concerns a process for manufacturing metal sections, in particular in aluminium alloys, continuously rolled by a series of pairs of rollers from an as-cast bar obtained by continuous casting in a grooved wheel, possibly followed by one or more stages of discontinuous or continuous wire drawing and annealing.

DESCRIPTION OF THE RELATED ART

For many years wire rod has been manufactured in non-ferrous alloys, particularly in aluminium alloys, from an as-cast bar continuously cast in the groove of a wheel which is rotated, the groove being blanked off by a tape engaged by the wheel. Known casting systems are those with 2 wheels with a small support wheel, 3 wheel systems, like the Properzi casting described in GB patent 1143264, 4 wheel systems like the Pechiney 4R casting described in FR 1178580, and 5 wheel systems like the one described in US 3416596.

The as-cast bar, of generally triangular or trapezoidal cross-section, is then continuously rolled through a series of successive stands made up of two rollers, and alternately horizontal and vertical, so as to obtain a wire of circular cross-section, which may be used as such or transformed by drawing.

In the case of aluminium alloys the process is widely used for light alloys, intended particularly for electrical conductors. With some adaptations, described for example in the patents FR 2234936 (Secim and Pechiney Aluminium), FR 2304414 (Secim) and FR 2359613 (Pechiney Aluminium), it has been possible to cast and roll without causing porosities of more heavily alloyed alloys with a higher solidification range, such as alloys of the 2000, 5000 and 7000 series according to the designations of the Aluminum Association, which can be used for mechanical applications.

To the knowledge of the applicant company, none of the existing continuous casting-roll machines has ever manufactured products of non circular cross-section. To be sure, it is normal to use round wire rod when the drawn end product is itself a round wire, which is the case for example for electrical conductors or wire for netting. There are, however, particularly in mechanical applications, drawn products of non circular cross-section, for example rectangular, triangular, polygonal or T-shaped, for which it would be more economical to start from a wire rod of related shape, which would reduce drawing passes, or even to leave the casting-roll machine in the final size without subsequent drawing.

One of the reasons which might explain the absence on the market of wire rod of non circular cross-section stems from the difficulty of controlling the geometry of the section during rolling. For a circular cross-section in fact, the product emerging from the final rolling stand remains on the groove of the rollers only via a generator, and its separation at output poses no problem. It is not the same for products whose cross-section comprises a plane part, for example a rectangular, triangular or T-shaped cross-section. They remain on the groove of the rollers of the final stand in a more or less wide band, the uneven detachment of which entails distortions in the geometry of the rolled product, as well as surface defects.

SUMMARY OF THE INVENTION

The purpose of the invention is to overcome this drawback and to allow accurate control of the geometry of the cross-section of the rolled product, when this cross-section comprises a polygonal part, i.e. at least two straight secant parts. The rolled section can then be used directly as it is, either continuously or discontinuously drawn so as to obtain a wire of non circular cross-section, with a smaller number of passes than starting with a circular section.

An object of the invention is a process for manufacturing metal sections of partially or totally polygonal cross-section by continuous casting in a grooved wheel and continuous rolling by means of at least 3 and preferably 3 to 8 pairs of rollers fitted with a peripheral groove, these rollers being placed symmetrically relative to the section, and alternately horizontal and vertical, a process which is characterised in that:

- the grooves of the first pairs of rollers are identical to those of the rollers used for the manufacture of sections of circular cross-section,
- the final pair of rollers comprises grooves delimiting a cross-section approximately corresponding to that of the section desired,
- the cross-section formed by the grooves of the final pair of rollers has at the apexes of the polygon radii of curvature between 1 and 5 mm,
- the sides of the polygon non parallel to the gap of the final pair of rollers have, relative to the corresponding sides of the cross-section of the final section a clearance between ½ and 3°.

An object of the invention is also a process for manufacturing discontinuously or continuously drawn metal sections of partially or totally polygonal cross-section from as-cast bars of partially or totally polygonal cross-section obtained by continuous casting in a grooved wheel and continuous rolling, in which the number of discontinuous or continuous wire drawing passes and the number of annealings are each reduced by at least one third relative to the process of the prior art starting from an as-cast bar of approximately circular cross-section.

DESCRIPTION OF THE PREFERRED EMBODIMENTS

Figure 1:
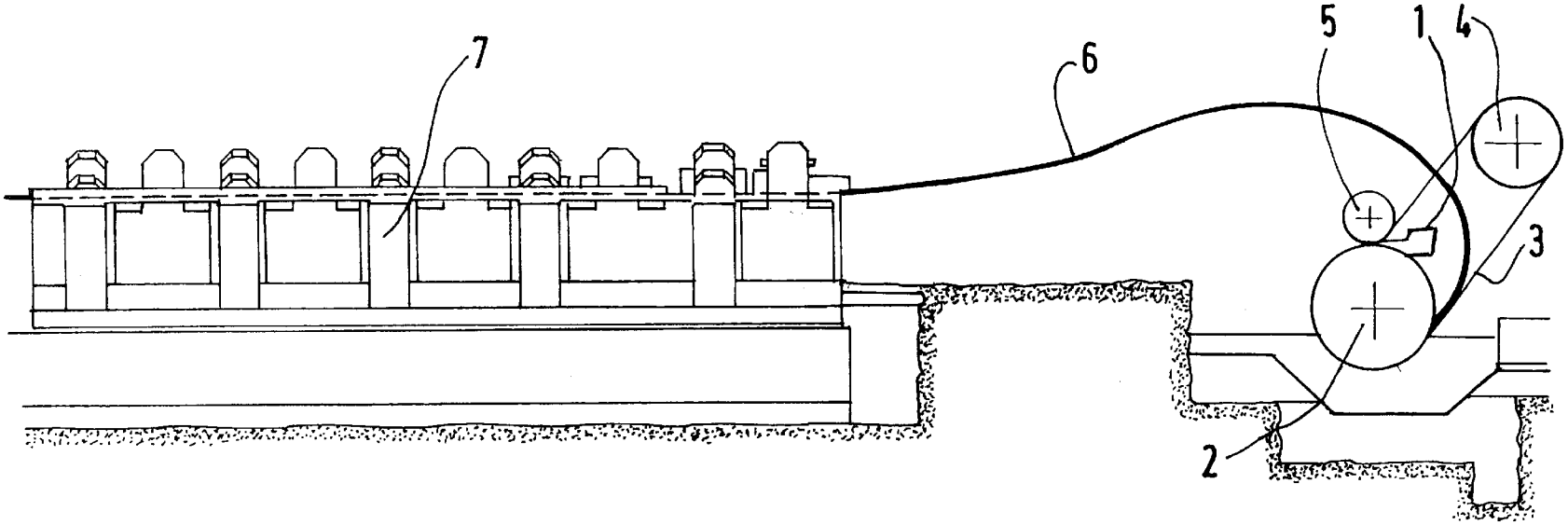
FIG. 1 shows a machine for continuous casting on a grooved wheel and the battery for continuous rolling of the as-cast bar.
Figure 2:
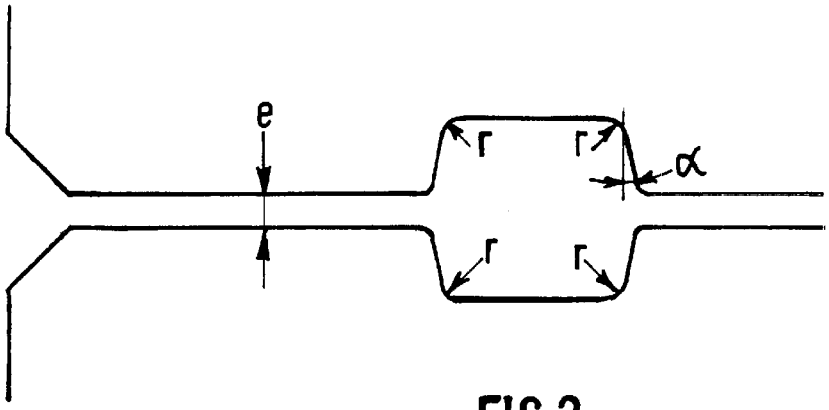
FIGS. 2 to 5 show, in cross-section along the plane of their axes of rotation, the final pair of rollers used for the rolling of the sections described in examples 1 to 4.
Figure 3:
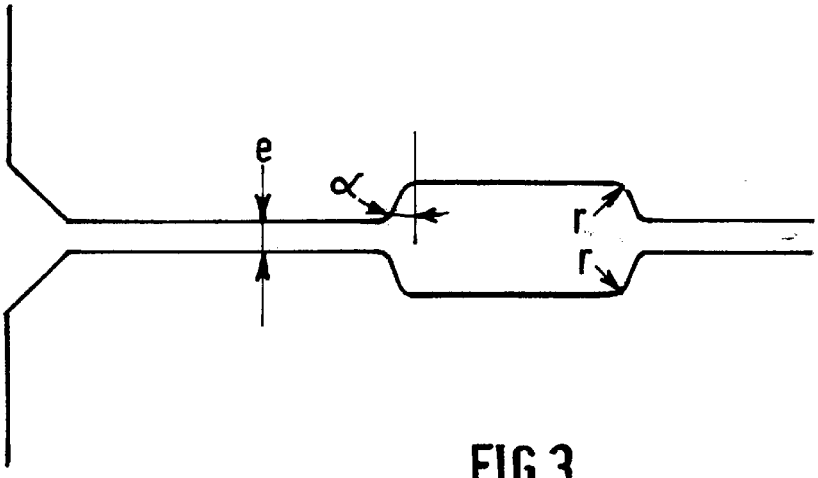

The manufacturing process according to the invention uses a casting machine comprising a liquid metal feed nozzle (1), a casting wheel (2), which is rotated, fitted with a peripheral groove, blanked off by a metal tape (3) engaged by the wheel. The machine may be a two-wheel machine and a follower wheel like the one shown in FIG. 1, the second wheel (4) serving to tension the tape, and the follower wheel (5) being intended to keep the tape on the casting wheel in the vicinity of the casting area. The machine may also be a three, four or five wheel machine. The cross-section of the as-cast bar (6), generally trapezoidal in shape, varies according to the installations between 900 and more than 3000 $mm^2$.

The number of rolling stands (7), each comprising a pair of rollers, is greater than two and preferably between 3 and 8. This number depends on the final cross-section to be obtained, since the initial cross-section is connected to the casting machine and cannot therefore be modified easily. The reduction of cross-section in each stand is, generally, between 10 and 40%. The accuracy of the geometry improves with the number of stands, but inversely a high number of stands tends to work harden the metal, which makes subsequent drawing more difficult. The first stands use rollers with the same grooves as those used for rolling wire of circular cross-section. The penultimate stand may comprise, as circumstances require, rollers identical to the first, either flat rollers, or rollers close in shape to the rollers of the final stand, which rollers have in all cases grooves delimiting a cross-section corresponding to the final cross-section desired.

However, experience has shown that if this cross-section is too close to the final cross-section, acceptable dimensional tolerances cannot be observed. Likewise, experience has shown that if the radii of curvature between the plane faces are too small, the metal tends to adhere to the rollers, which causes incidents on the line and imposes stoppages. According to the invention, these drawbacks are avoided by adapting the shape of the groove of the finisher rollers, which provides easy withdrawal and good filling of the shapes of the grooves. This adaptation is obtained by providing radii of curvature between the plane faces between 1 and 5 mm, and, for the faces not parallel to the gap of the rollers, clearances, i.e. angles between the groove and the corresponding face of the section, between ½ and 3°.

Special precautions must be taken in winding the section at the end of rolling. Unlike when winding wire of circular cross-section, a small space must be provided between the coils and they must not be allowed to overlap.

The continuous casting process according to the invention allows metal sections to be made, particularly in aluminium alloys or copper, of square, rectangular, triangular and more generally partially or totally polygonal cross-section, with good dimensional tolerances, of about 0.1 mm, and with good detachment of the metal from the last rolling stand.

These sections may be used as such in numerous mechanical or electrical applications, or for the manufacture of weld wire. They can also be transformed by discontinuous or continuous wire drawing in one or more passes, in order to confer on them dimensions, tolerances on dimensions and shape, or particular mechanical characteristics. Some of these products, obtained from wire rod of circular cross-section, are known. The fact of using as an as-cast bar for continuous or discontinuous wire drawing a wire rod of partially or totally polygonal cross-section according to the invention considerably Simplifies the manufacturing process since the shape of the transverse cross-section of the as-cast bar can be very close to that of the drawn product required. Furthermore, leaks of lubricant between the metal and the die obtained when the geometry of the as-cast bar and that of the die are too different are avoided. The manufacturing process for discontinuously or continuously drawn wire of partially or totally polygonal cross-section according to the invention is characterised in that a selection is made, for a given cross-section of the final section, of a cross-section of the as-cast bar such that the number of discontinuous or continuous wire drawing passes and annealings can be minimised. Relative to a wire rod of approximately circular cross-section, and by choosing for each discontinuous or continuous wire drawing pass, a work hardening rate E (input cross-section—output cross-section)/output cross-section close to the maximum value (about 80% for aluminium alloys) that the wire can withstand without developing crippling defects, the professional is able to define, for a wire in an aluminium or copper alloy, a range of manufacture such that the number of discontinuous or continuous wire drawing passes and the number of annealings are each reduced by at least one third. This gain is greater for cross-sections which, at least locally, are the furthest removed from a circular cross-section (V or T cross-sections, very elongated flats and particularly those having a cross-section such that the ratio of width to thickness is greater than 2).

The exact number of discontinuous or continuous wire drawing passes depends on the type of alloy used, as well as on the parameters of the discontinuous or continuous wire drawing process. For aluminium alloys and sections of square or triangular cross-section, discontinuous or continuous wire drawing can most often be limited to a single pass with one annealing, instead of at least two passes and two annealings starting from a circular as-cast bar. For sections of rectangular cross-section with a ratio of width to thickness between 1 and 2, discontinuous or continuous wire drawing can be limited to two passes and one annealing, and for width to thickness ratios between 2 and 5, to three passes and two annealings. Sections of rectangular cross-section with a width to thickness ratio greater than 4 are moreover very difficult to make by drawing from an as-cast bar of round cross-section, with the result that the process according to the invention allows an enlargement of the possibilities of manufacture of wire works.

The process according to the invention can be used for a great variety of metal alloys, particularly aluminium alloys, including heat treatable alloys (2000, 6000 and 7000 series) and cuprous alloys.

EXAMPLES

For all the examples, the metal was cast on a continuous casting machine of the 3 wheel type, in a grooved wheel leading to an as-cast bar trapezoidal in shape, of greater width 41 mm and of a height of 29 mm, i.e. an as-cast bar cross-section of 1050 $mm^2$.

Example 1

From an as-cast bar of 1050 $mm^2$ cross-section, in aluminium alloy 5754 according to the designation of the Aluminum Association, a section is made of square cross-section 13×13 mm, by rolling through 6 stands, each comprising a pair of rollers circular in shape made of Z38CDV5 steel processed at 52 HRC. On leaving each stand the speeds are obtained that are mentioned in table 1, as well as the cross-sections falling within the formats shown in the same table:

TABLE 1

| Stand no. | cross-section of rollers | format (mm × mm) | speed (m/s) |
|---|---|---|---|
| 1 | Standard | 45 × 19.5 | 19 |
| 2 | Standard | 27 × 26 | 29.5 |
| 3 | Standard | 33 × 13.9 | 38 |
| 4 | Standard | 17.5 × 18 | 57 |
| 5 | Flat | clearance 12.5 | 83 |
| 6 | Square | 13.2 × 13.2 | 84 |

The first 4 pairs of rollers have grooves delimiting a circular cross-section, as is the case for the continuous rolling of sections of circular cross-section. The fifth pair of rollers delimits a flat gap and the sixth delimits a square cross-section very close to that of the finished product. The gap between the rollers of this sixth pair is 2 mm. The radii of curvature of the cross-section of the grooves of the rollers at the 4 apexes of the square are 3 mm. The clearances on the perpendicular square sides at the gap of the rollers are of 1°.

No adhesion of the section on the output rollers is obtained and the tolerances on the cross-section of the section are less than 0.1 mm.

Example 2

Starting from an as-cast bar of the same cross-section as in the previous example, a flat is made of rectangular cross-section 16.5×8.1 mm of aluminium alloy 2017, by continuous rolling through 6 stands. The types of rollers used, the formats and the speeds on leaving each stand are given in table 2.

TABLE 2

| Stand no. | cross-section of rollers | format (mm × mm) | speed (m/s) |
|---|---|---|---|
| 1 | standard | 45 × 19.5 | 19 |
| 2 | standard | 27 × 26 | 29.5 |
| 3 | standard | 33 × 13.9 | 38 |
| 4 | standard | 17.5 × 18 | 57 |
| 5 | standard | 21.6 × 10.2 | 83 |
| 6 | rectangular | 16.5 × 8.1 | 114 |

The first 5 Pairs of rollers have standard grooves similar to those used for the rolling of sections of circular cross-section. The sixth pair has a gap of 1.5 mm and its grooves delimit a rectangle the apexes of which have a radius of curvature of 2 mm and the sides perpendicular to the gap a clearance of 1°. No adhesion of the section on leaving the last stand is noted and the tolerances on the dimensions of the section are less than 0.1 mm.

Example 3

A section is made of aluminium alloy 1370 having a cross-section in the general shape of a circular sector, delimited by a triangle below and a circle arc above, falling within a rectangle 16.2×12.2 mm, and of cross-section 150 $mm^2$. The types of rollers, the formats and the speeds on leaving each stand are shown in table 3

TABLE 3

| Stand no. | cross-section of rollers | format (mm × mm) | speed (m/s) |
|---|---|---|---|
| 1 | standard | 45 × 19.5 | 19.6 |
| 2 | standard | 27 × 26 | 30.1 |
| 3 | standard | 33 × 14.6 | 41.2 |
| 4 | standard | 18 × 18 | 64.2 |
| 5 | sector | 17.3 × 14.8 | 88.2 |
| 6 | sector | 12.2 × 16.2 | 114 |

The first 4 pairs of rollers have standard grooves similar to those of the rollers used for the continuous rolling of the sections of circular cross-section. The grooves of the fifth pair delimit a cross-section in the shape of a sector. The sixth pair has grooves delimiting a cross-section in the shape of a circular sector, with a radius of curvature of 3 mm between the 2 plane parts, a clearance of 1° on these plane parts and a gap between the 2 rollers of 1.5 mm. The upper part of the cross-section, in the shape of a circle arc is carefully polished. No adhesion of the section on leaving the last stand is noted and the tolerances on the dimensions of the section are less than 0.1 mm.

Example 4

Figure 4:
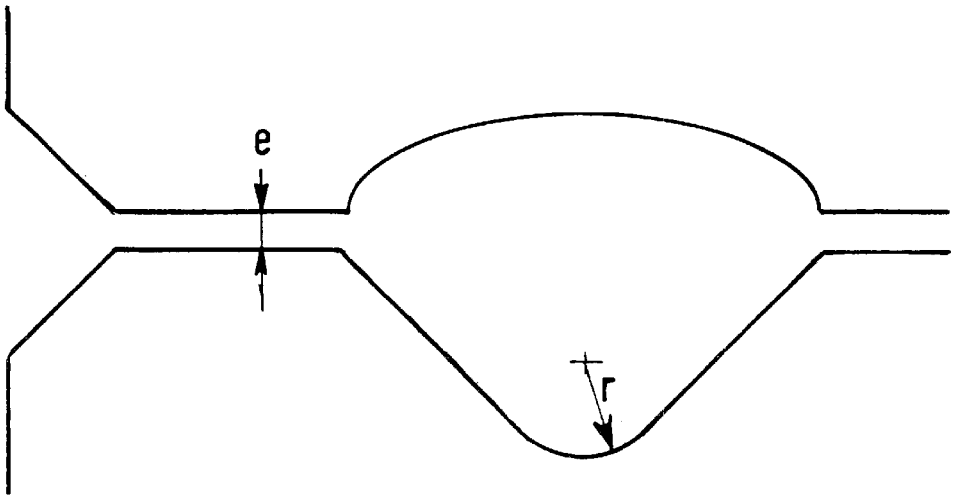
Figure 5:
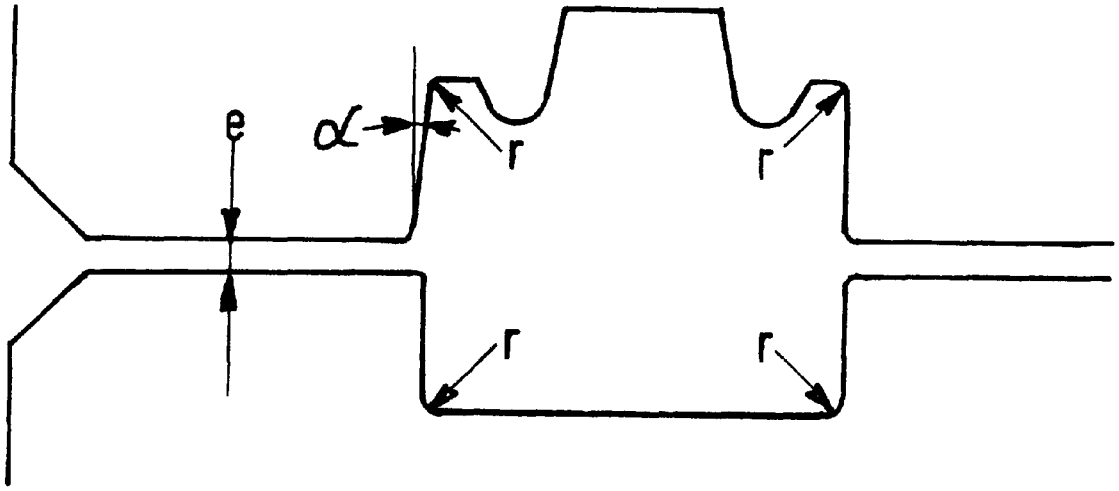

A section is made, intended for electrical applications, of aluminium alloy 1370 in the shape shown in FIG. 4 of cross-section 490 $mm^2$. The types of rollers, the formats and the speeds on leaving each stand are shown in table 4.

TABLE 4

| Stand no. | cross-section of rollers | format (mm × mm) | speed (m/s) |
|---|---|---|---|
| 1 | standard | 45 × 20.5 | 18 |
| 2 | flat | 28 × 19.5 | 28 |
| 3 | shaped | | 32 |

Only 3 stands are used, only the first of which has standard rollers. The second stand has flat rollers and the third has rollers the grooves of which delimit the cross-section desired. For this final pair, the radii of curvature at the apexes of the sharp angles are 1.1 mm and the clearances on the vertical faces of 1.5°. The grooves are very carefully polished. The gap used is 2 mm.

Example 5

A square wire is made of square cross-section 10 mm×10 mm of aluminium alloy 5754, intended for the manufacture of bolts for fixing bakelite handles onto culinary utensils made of aluminium, by drawing in a single pass starting from the section of square cross-section 13×13 mm described in example 1. The usual range according to the prior art started from an as-cast bar of circular cross-section of 18 mm diameter and comprised two drawing passes, separated by an annealing-greasing in 13×13 mm format.

Example 6

A flat wire is made of cross-section 15.0×4.0 mm of aluminium alloy 2017 starting from a flat section of rectangular cross-section 16.5×8.1 mm described in example 2, by drawing into one three drawing passes, separated by an annealing-greasing in the intermediate formats 16.0×6.3 mm and 15.65×4.45 mm. The usual range according to the prior art started from an as-cast bar of circular cross-section of 18 mm diameter and comprised 6 passes of drawing separated each time by an annealing-greasing in the intermediate formats 17.3×13.8 mm, 16.6×10.7 mm, 16.2×8.2 mm, 16.0×16.3 mm, 15.65×4.85 mm.

What is claimed is:

1. A process for manufacturing a metal profile of partially or totally polygonal cross-section comprising the steps of continuously casting metal in a grooved wheel and continuously rolling the cast metal by means of at least 3 pairs of rollers fitted with a peripheral groove, said rollers being placed symmetrically relative to the profile, and alternately horizontal and vertical, wherein:

the rollers are arranged such that the grooves of the first pairs of rollers are identical to the grooves of the rollers used for the manufacture of profiles of circular cross-section, the rollers are arranged such that the final pair of rollers comprises grooves delimiting a cross-section approximately corresponding to that of a desired profile, the cross-section formed by the grooves of the final pair of rollers has at apexes of a polygon, radii of curvature between 1 and 5 mm, and the sides of the polygon non parallel to the gap of the final pair of rollers have, relative to corresponding sides of the cross-section of the final profile, a clearance angle between ½ and 3°.

2. A process according to claim 1, wherein the profile has a square or rectangular cross-section.

3. A process according to claim 2, wherein the profile has a rectangular cross-section with a width/thickness ratio >4.

4. A process according to claim 3, wherein the profile has a triangular cross-section.

5. A process according to claim 1, wherein the profile has a T-shaped or V-shaped cross-section.

6. A process according to claim 1, additionally comprising a pair of rollers having a plane surface in a penultimate position.

7. A process according to claim 1, followed by at least one discontinuous or continuous wire drawing pass step and optionally by at least one annealing step.

8. A process according to claim 7, wherein the number of drawing pass steps and the number of annealing steps are each reduced by at least one third relative to a process which would use as an as-cast bar for discontinuous or continuous wire drawing a wire rod of approximately circular cross-section to obtain a similar product.

9. A process according to claim 8, wherein the profile is made of an aluminum alloy, of square or triangular cross-section and the process includes only one discontinuous or continuous wire drawing pass and only one annealing step.

10. A process according to claim 9, wherein the aluminum alloy is a 5000 series alloy.

11. A process according to claim 10, wherein the aluminum alloy is a 5756 alloy.

12. A process according to claim 8, wherein the profile is made of an aluminum alloy of rectangular cross-section with a width to thickness ratio between 2 and 5, and that the process includes at least 3 discontinuous or continuous wire drawing pass steps and 2 annealing steps.

13. A process according to claim 12, wherein the aluminum alloy is a 2000 series alloy.

14. A process according to claim 13, wherein the aluminum alloy is a 2017 alloy.

15. A process according to claim 8, wherein the profile is made of an aluminum alloy of rectangular cross-section with a width to thickness ratio between 1 and 2, and the process includes at least 2 discontinuous or 3 continuous wire drawing pass steps and one annealing step.

16. A process according to claim 1, wherein there are from 3 to 8 pairs of rollers.

* * * * *